United States Patent [19]

Theurer et al.

[11] Patent Number: 4,938,239

[45] Date of Patent: Jul. 3, 1990

[54] MOBILE TRACK BED CLEANING MACHINE AND METHOD

[75] Inventors: Josef Theurer, Vienna; Friedrich Oellerer, Linz, both of Austria

[73] Assignee: Franz Plasser Bahnbaumaschinen-Industriegesellschaft m.b.H., Vienna, Austria

[21] Appl. No.: 324,424

[22] Filed: Mar. 15, 1989

[30] Foreign Application Priority Data

Apr. 13, 1988 [EP] European Pat. Off. ..... 88890092.5

[51] Int. Cl.[5] ..... B08B 5/04; B08B 7/04; A47L 5/14

[52] U.S. Cl. ..... 134/21; 134/37; 15/340.1; 15/345; 15/346

[58] Field of Search ..... 134/21, 37; 15/340.1, 15/345, 346

[56] References Cited

U.S. PATENT DOCUMENTS 3,977,039 8/1976 Block ..... 15/340.1
4,570,287 2/1986 Kerschner ..... 15/346

FOREIGN PATENT DOCUMENTS 384446 4/1987 Austria .
977910 11/1975 Canada ..... 15/346
1244221 7/1967 Fed. Rep. of Germany .
2217975 10/1973 Fed. Rep. of Germany ..... 15/340.1
2218351 11/1973 Fed. Rep. of Germany ..... 15/346
8236650 6/1983 Fed. Rep. of Germany .
3318756 11/1984 Fed. Rep. of Germany ..... 15/345
2074565 10/1971 France .

OTHER PUBLICATIONS

"Der Stadtverkehr", 11/12/1980.
"Der Stadtverkehr", 8/1980, p. 3.
"Der Nahverkehr", 4/1987, pp. 14–21.

*Primary Examiner*—Asok Pal
*Assistant Examiner*—Ourmazd S. Ojan
*Attorney, Agent, or Firm*—Kurt Kelman

[57] ABSTRACT

A mobile machine for cleaning a track bed comprises a suction arrangement on the machine frame, the suction arrangement comprising a suction head having an inlet port, a suction conduit, a ventilator connected to the suction head by the suction conduit for producing suction at the inlet port, and a receptacle incorporating a filter connected to the suction conduit; and a compressed air generating arrangement associated with the suction arrangement, the compressed air generating arrangement comprising a compressed air discharging nozzle arranged within the inlet port of the suction head, a compressed air conduit, and compressed air generator connected to the nozzle by the compressed air conduit, the suction and compressed air generating arrangements forming a substantially closed pressure-suction system.

16 Claims, 2 Drawing Sheets

MOBILE TRACK BED CLEANING MACHINE AND METHOD

BACKGROUND OF THE INVENTION

1. Field of the Invention

The present invention relates to a mobile machine for cleaning a bed supporting a track consisting of two rails fastened to ties, particularly a ballast bed wherein the track ties are embedded, which comprises a machine frame and undercarriages supporting the machine frame on the track rails for mobility in an operating direction. A suction arrangement on the machine frame comprises a suction head means having an inlet port means, suction conduit means, a ventilator connected to the suction head means by the suction conduit means for producing suction at the inlet port, and a receptacle incorporating a filter connected to the suction conduit means, and a compressed air generating arrangement associated with the suction arrangement comprises compressed air discharging nozzle means, compressed air conduit means, and compressed air generator means connected to the nozzle means by the compressed air conduit means, the suction and compressed air generating arrangements forming a substantially closed pressure-suction system.

2. Description of the Prior Art

An advertisement on page 462 of the periodical "Der Stadtverkehr", 11/12, 1980, covers such a mobile machine for cleaning the surface of a track with a pressure-suction system. The advertised machine comprises two vehicles coupled together for respectively cleaning one half of the track. The pressure-suction system is described in some detail in an article on page 3, No. 8, 1980, of the same periodical, in connection with the suction system of similar track cleaning vehicles. In accordance with the sketch shown in page 3, the suction arrangement comprises a suction head, a suction conduit having an inlet port, a ventilator having a radial blower connected to the suction head by the suction conduit for producing suction in the inlet port, and a receptacle incorporating a filter connected to the suction conduit. The suction arrangement is termed a pressure-suction nozzle, and a bell-shaped pressure nozzle is associated with the suction head, a pressure conduit connecting the radial blower to the pressure nozzle. The suction head is arranged within the bell-shaped pressure nozzle and the air flowing under pressure through the pressure conduit from the radial blower to the pressure nozzle is sucked with dirt into the inlet port and thence through the suction conduit into the receptacle. Such a machine with two coupled vehicles is relatively expensive. Furthermore, the pressure nozzle surrounding the suction head requires a considerable suction force to prevent the surface ballast from being blown away or a dust cloud from rising through openings defined between the edge of the pressure nozzle and the surface of the ballast bed.

German Pat. No. 2,217,975, published Dec. 20, 1979, disclosed a mobile suction machine for cleaning the surface of a ballast bed, which comprises a machine frame supported by undercarriages for mobility on the track and carrying a receptacle, a filter and a ventilator. A suction arrangement is mounted between the two undercarriages on a carriage linked to the machine frame by rods, the suction arrangement being constituted by a suction head extending over the entire track width. Except at the tie ends, the inlet port of the suction head is delimited by vertically adjustable edge stripping comprised of several transversely adjacent and independently vertically adjustable strips forming pairs of air guide elements at both sides of the inlet port. The suction arrangement comprises suction conduits connected to a receptacle. The independently operable air guide elements are particularly useful for operation of the machine in track switches. The construction is quite elaborate and the lower portions of the air guide strips are subject to considerable wear. Furthermore, the arrangement is not capable of removing encrusted dirt from the surface of the ballast bed.

An article on pages 14–21, No. 4, 1987, of the periodical "Der Nahverkehr" discloses different self-propelled vacuum cleaner trains most of which operate on the pressure-suction principle. These machines are used for surface cleaning of short-distance tracks, such as subways or commuter railroads. Because such tracks are dirtied by such debris as cigarette butts, paper and the like, as well as by brake sand, dust and metallic abrasions from the rails, this problem of track surface cleaning has received added attention not only to improve the appearance of the tracks but also to maintain the elasticity of the ballast bed by reducing its encrustation by dirt. In these cleaning trains, the dust-containing air is cleaned by dry or wet filters. However, these rather complicated vacuum cleaner trains still fail to produce efficient cleaning and do not remove encrusted dirt strongly adhering to the ballast or dirt lodged below the surface between the ballast rocks.

Austrian Pat. No. 384,446, published Apr. 15, 1987, discloses a mobile machine for sucking the entire ballast out of a ballast bed. The removed ballast is cleaned on a screen arranged on the machine and the cleaned ballast is redistributed. The suction arrangement is vertically adjustable mounted on the machine frame and is comprised of three suction nozzles each having an inlet port and its own flexible suction conduit connected to the screen and a compressor. Ballast clearing tools rotatable in the track plane for loosening the ballast are associated with the suction nozzles. This machine has not yet been commercially used but does not appear to be adapted for cleaning the surface of a ballast bed.

Another machine designed for this purpose has been disclosed in German utility model No. 8,236,650 whose grant was published on June 30, 1983. This machine is equipped with a simple suction arrangement comprising a transversely and longitudinally displaceable suction head and a suction pipe connecting the suction head to a screening arrangement. Elastic, vertically adjustable edge strips are connected to the inlet port of the suction head to close off the inlet port, except for a receiving inlet oriented in the operating direction. The suction head is a nozzle of relatively small, round or rectangular cross section to enable the heavy ballast to be efficiently sucked in for subsequent cleaning. This machine cannot be used for cleaning the surface of a ballast bed.

Finally, German Pat. No. 1,244,221, published July 13, 1967, discloses a device for cleaning switches and rails, which may be mounted on a carriage. A vertically adjustable wagon is mounted between the front and rear wheels of the carriage and is equipped with a nozzle box associated with each rail. A suction, compressed air, pressurized water and lubrication nozzle are mounted in each box. It is not possible to clean the surface of a ballast bed with this machine.

SUMMARY OF THE INVENTION

It is the primary object of this invention to improve a track bed cleaning machine of the first-described type so that it will more efficiently and throughly remove dirt adhering to a track bed.

This and other objects are accomplished according to the invention in such a machine in an unexpectedly simple manner by arranging the compressed air discharging nozzle means within the inlet port means of the suction head means.

The arrangement of the compressed air discharging nozzle means within the inlet port means of the suction head means in the center of the suction arrangement produces a very strong air turbulence resulting in a correspondingly powerful cleaning effect because of the sudden reversal of the compressed air flow from the direction of the surface of the ballast bed into the direction of flow of the suction air sucked into the suction conduit by the ventilator. This makes it possible to remove and suck in even encrusted dirt with high efficiency. It is of particular advantage that the entire suction air flow along the circumferential edge of the inlet port is directed exclusively upwardly away from the ballast bed surface so that all the dirt along the edge is dependably sucked up. In this way, the environment remains clean because none of the sucked-in air containing the dirt can be pressed out of the suction arrangement. This advantageous combination of the compressed air discharging nozzle and the suction inlet port results in a reinforced suction air flow because the path of this flow is exactly determined by the arrangement of the nozzle within the inlet port so that all the dirt is subjected to the downward pressure of the compressed air as well as the upward suction, which will cause a strong turbulence and detach even strongly adhering dirt particles from the ballast. Since no air from the atmosphere surrounding the circumferential edge of the inlet port is sucked in in the arrangement of the present invention, the suction arrangement may be advantageously centered over each crib as the machine advances intermittently from crib to crib while the side edges of the inlet port are lowered into engagement with the two adjacent ties. This complete covering of the crib by the inlet port, which is connected to the suction conduit, enables the ballast bed surface of the crib to be subjected to a very intensive pressure-suction air flow for removing dirt adhering to the ballast and/or lodged in the crevices thereof. The compressed air discharging nozzle may be selectively actuated so that the machine may be operated only with the suction arrangement if the ballast bed is relatively clean, in which case the machine is advanced continuously while the suction head is held at a constant distance from the ballast bed surface, compressed air being discharged from the nozzle only at those spots more heavily encrusted with dirt so that the impact of the compressed air aids the suction in removing such dirt.

BRIEF DESCRIPTION OF THE DRAWING

The above and other objects, advantages and features of the present invention will become more apparent from the following detailed description of certain now preferred embodiments thereof, taken in conjunction with the accompanying somewhat schematic drawing wherein

FIG. 1 is a fragmentary top view of FIG. 1;

DETAILED DESCRIPTION OF PREFERRED EMBODIMENTS

Figures 1, 2, 3:
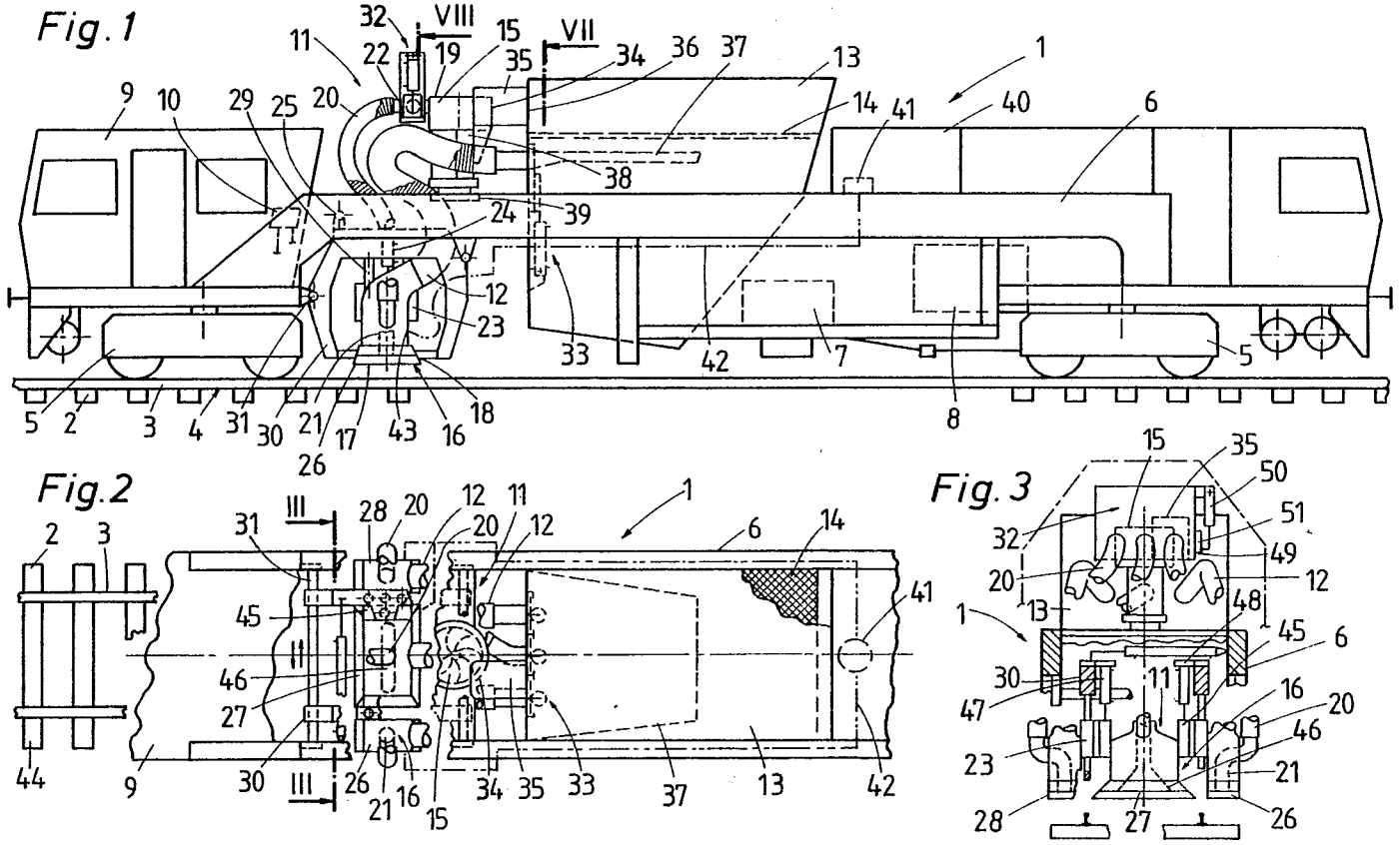
FIG. 1 is a side elevational view of a mobile track bed surface cleaning machine according to one embodiment of this invention.
FIG. 3 is a sectional view along line III—III of FIG. 2.

Referring now to the drawing and first to FIGS. 1 to 3, there is shown mobile machine 1 for cleaning a bed supporting track 4 consisting of two rails 3 fastened to ties 2. The machine comprises machine frame 6 and undercarriages 5, 5 supporting the machine frame on the track rails for mobility in an operating direction. The machine is self-propelled and has drive 7 connected to the wheels of one of the undercarriages, a central power plant 8 being mounted on the machine frame for supplying power to all the drives of the machine. One end of machine frame 6 carries operator's cab 9 which houses central control panel 10.

Suction arrangement 11 is carried on machine frame 6 between undercarriages 5 and extends over the entire width of the track. It comprises suction head means 16 having inlet port means 17, suction conduit means 12, radial ventilator 15 having suction port 34 connected to the suction head means by the suction conduit means for producing suction at the inlet port means, and receptable 13 incorporating filter 14 connected to the suction conduit means for receiving sucked-in dirt, the filter purifying the sucked-in air passing therethrough on its way to the suction port of the ventilator. The machine further comprises compressed air generating arrangement 19 associated with suction arrangement 11 and comprising compressed air discharging nozzle means 21 arranged within inlet port means 17 of the suction head means, compressed air conduit means 20 and a compressed air generator constituted by exhaust port 22 of ventilator 15, the compressed air conduit means connecting the exhaust port to nozzle means 21, suction and compressed air generating arrangements 11 and 19 forming a substantially closed pressure-suction system.

The compressed air discharging nozzle means is centered within inlet port means 17 and extends at least in a lower portion of the inlet port means coaxially therewith.

This relatively simple connection of the compressed air discharge nozzle within the suction inlet port makes it possible to use the exhaust of the radial ventilator in the suction arrangement as the pressure source in the compressed air generating arrangement. Particularly since the rim defining suction head inlet port 17 comprises a vertically adjustable strip 18 of elastic material extending therefrom substantially to the surface of the ballast bed, except in the area of the two track rails, the closed suction-pressure cycle will assure an air flow preventing any escape of dust into the ambient atmosphere, thus protecting the environment. Since nozzle 21 is centered coaxially at least in the lower portion of suction inlet port 17, the compressed air will be blown centrally within the suction head against the ballast bed surface surrounded and covered by elastic strip 18, and this air flow will be deflected 180° into suction conduit 12 as it blows over the ballast bed surface, producing a considerably enhanced cleaning effect. The resultant turbulence produced by the simultaneous pressure and suction will aid in dislodging even encrusted dirt and dirt particles lying below the surface within the crevices of the ballast.

Illustrated suction head means 16 comprises three suction heads 26, 27, 28 arranged adjacent each other transversely to track 4. Each suction head has a substantially rectangular inlet port 17 and a respective cylindrical compressed air discharging nozzle 21 is arranged in each rectangular inlet port of outer suction heads 26, 28 while slot-shaped compressed air discharging nozzle 46 is arranged in the inlet port of central suction head 27 and extends transversely to the track. To enable the suction heads to be independently vertically adjusted, each outer suction head 26, 28 is supported on carrier frame 23 vertically displaceably mounted on guide column 29 of support frame 30 by vertical adjustment drive 24. The support frame is transversely displaceably mounted by transverse guides 31 on machine frame 6. Transverse cylinder-piston adjustment drive 25 has its cylinder connected to machine frame 6 while its piston is connected to one of support frames 30. The two sides of central suction head 27 are connected with carrier frames 45 which have their own vertical cylinder-piston adjustment drives 47 whose cylinders are connected to support plates 48 affixed to support frame 30 while their pistons are connected to carrier frames 45. A vertical dove-tailed guide vertically displaceably mounts carrier frames 45 on carrier frames 23. To enable the suction heads to be vertically and/or transversely adjusted without difficulty, all the conduits are flexible hoses. Compressed air discharging nozzles 21 are led from their compressed air conduits 20 through the outer walls of suction heads 26, 28 into inlet ports 17, as clearly shown in FIG. 3. Such a suction head arrangement enables the entire track bed to be covered, except for the rails, and the rims of the suction head inlet openings may be engaged with the ties and the rail bases to increase the suction cleaning effect on the ballast bed surface while largely excluding ambient air from being sucked in through openings between the ballast bed surface and the inlet port rim.

As shown in FIGS. 2 and 3, center suction head 27 is arranged between the two track rails 3 and a respective outer suction head 26, 28 is arranged laterally outside a respective track rail in the range of a respective tie end 44. A respective control device 32, 33 is arranged in compressed air conduits 20 and in suction conduits 12, more particularly at the connecting end of the compressed air conduits to exhaust port 22 of ventilator 15 and the connecting end of the suction conduits to dirt receptable 13, respectively. Compressed air flow control device 32 has an exhaust port 49 (see FIG. 3) which may be opened and closed by remote controlled drive 50 actuating sliding valve 51. Phantom lines indicate the selectively controllable size of this exhaust port. These control devices will be described in detail hereinafter in connection with FIGS. 7 and 8.

Channel 35 connects suction port 34 of ventilator 15 to outlet port 34 of dirt receptacle 13. The ends of suction conduits 12 opposite to inlet ports 17 are connected to a wide, umbrella-shaped nozzle 37 inside the dirt receptacle which blows the sucked-in dirt-laden air into the receptacle where the dirt is filtered out by filter 14 and the purified air flows through outlet port 34 into channel 35 and suction port 34. Ventilator 15 is hydraulically operated and is supported on vertical carrier 38 whose lower end is supported on machine frame 6 by bracket 39.

In the illustrated embodiment, the suction heads further have water discharging nozzles 43 above inlet ports 17 and machine frame 6 carries water tank 40 and water pump 41 having an input and an output,the pump input receiving water from the water tank, and conduits 42 connecting the pump output to the water discharging nozzles. The water discharging nozzles preferably extend substantially horizontally through suction heads 26, 27, 28. The water discharged from nozzles 43 is finely atomized within the annular space surrounding compressed air discharging nozzle 21 by the turbulence in that space so that the sucked-in dust is humidified and the humidified dirt particles carried along by suction in conduit 12 will fall into the connected dirt receptacle by gravity.

Figure 4:
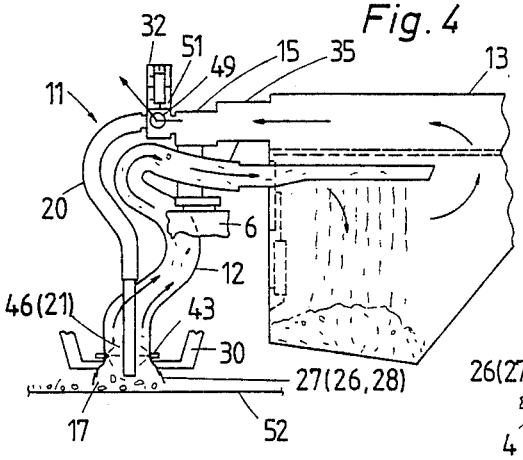
FIG. 4 is a diagrammatic side elevation of the suction arrangement used in the machine illustrated in FIGS. 1 to 3.

In the operating position illustrated in FIG. 4, exhaust port 49 of compressed air flow control device 32 is in the open position by raising slide valve 51. As shown, the suction heads are slightly spaced from surface 52 of the track bed which may be formed by concrete slabs.

Figure 5:
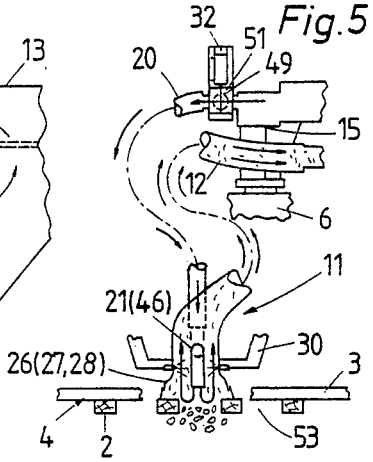
FIG. 5 is a like view of the suction arrangement in which the exhaust produced by the suction is recycled to a compressed air discharging nozzle in a closed pressure-suction system.

FIG. 5 schematically illustrates the operation of suction arrangement 11 in an intermittent cleaning of the surface of the track bed, in which operation suction heads 26, 27, 28 are lowered intermittently over succeeding cribs 53, the inlet ports of the suction heads having a width extending in the direction of track 4 which is greater than the average crib width. In this way, the leading and trailing rims of the suction heads are in engagement with successive ties 2 defining the cribs therebetween. A closed pressure-suction system is obtained by closing exhaust port 49 by lowering slide valve 51 so that ventilator 15 delivers exhaust air into pressure conduits 20. Since the vertically adjustable and elastic rims 18 are in contact with the ties, the inlet ports of the suction heads will be substantially hermetically sealed so that the suction effect is considerably enhanced. The width of the inlet port, preferably about 60 cm, is sufficient to assure that even when the crib widths vary somewhat, the cribs will always be fully straddled by the suction heads to assure intensive cleaning of the track bed surfaces between the ties.

Figure 6:
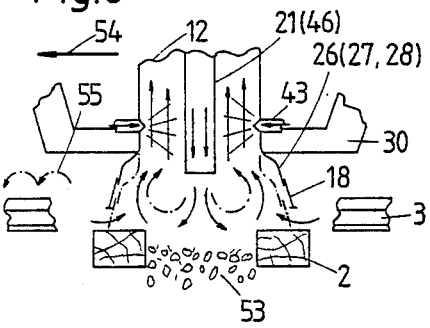
FIG. 6 is a like enlarged view of the suction head in the area of its inlet port, the raised operating position during a continuous advance of the machine being shown in full lines while the lowered operating position during an intermittent advance from crib to crib is indicated in phantom lines.

In the operating mode of FIG. 6, the machine is continuously advanced in an operating direction indicated by arrow 54 while the suction heads are raised to space rims 18 from ties 2, as indicated in full lines. Short arcuate arrows 55 illustrate a cyclical operation in which, as shown in phantom lines, the suction heads are intermittently lowered over succeeding cribs.

Figure 7:
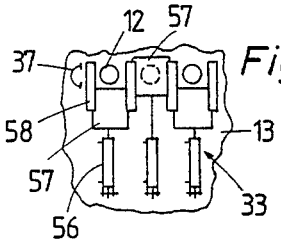
FIG. 7 is a fragmentary sectional view along line VII of FIG. 1, showing the receptacle of the suction arrangement and the remote-controlled valves for selectively opening and closing the suction conduits thereof.

Control device 33 shown in FIG. 7 comprises three slide valves 57 between respective suction conduits 12 connecting the inlet ports of respective suction heads to dirt receptacle 13, each slide valve being actuated by a remote-controlled drive 56 for displacement along respective guide 58 in the side wall of the receptacle. In the illustrated position, center valve 57 has been raised to close suction conduit 12 leading from center suction head 27 to the receptacle while the suction conduits leading from outer suction heads 26, 28 are open to suck dirt from the track shoulders into the receptacle.

Figure 8:
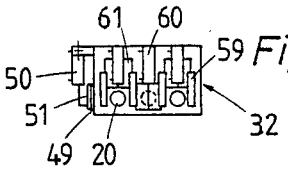
FIG. 8 is a fragmentary sectional view along line VIII of FIG. 1, showing the remote-controlled valves for selectively opening and closing the compressed air conduits of the compressed air generating arrangement.

Control device 32 shown in FIG. 8 for the selective closing of compressed air delivering conduits 20 comprises three slide valves 61 between the exhaust port of the ventilator and these conduits, the slide valves being displaceable in guides 59 by remote-controlled drives 60. In this illustrated operating position, the center valve 60 closes center conduit 20 so that center suction head 27 is shut off from pressure as well as suction and only outer suction heads 26, 28 are operative.

This selective control of the three suction heads makes it possible to operate the machine according to prevailing dirt conditions along the track. For instance, to clean the track shoulder alongside a station platform, which often is particularly dirty, the suction head at that shoulder may be operated with a combined compressed air blast and suction while the two other suction heads are operated only with suction and the compressed air delivery to the inlet port is shut off. If desired, any one of the suction heads may be temporarily shut off completely.

The operation of cleaning machine 1 illustrated in FIGS. 1 to 8 will now be explained in detail in connection with a variety of advantageous cleaning methods.

Cleaning of a Track Bed without Ballast

This operation is illustrated in FIG. 4 and is applicable to a track bed whose surface 52 is constituted, for example, by concrete slabs. Usually, dirt can be vacuumed from such flat surfaces relatively easily. Therefore, cleaning machine 1 is continuously advanced along the track while suction heads 26, 27, 28 are slightly spaced from track surface 52 and suction is applied to inlet ports 17 to suck the dirt through suction conduits 12 into dirt receptacle 13. As shown in FIG. 8, exhaust port 49 of control device 32 is opened by actuating drive 50 while all compressed air delivering conduits 20 are closed by lowered slide valves 61. In this manner, the dirt sucked in by ventilator 15 with the air is filtered out in receptacle 13 by filter 14 and the dirt-free air is vented to the atmosphere through exhaust port 49. If the operator observes particularly dirty track areas, he can at any time open a respective compressed air delivering conduit 20 and close exhaust port 49 by remote control to deliver compressed air to a nozzle 21, 46 to reinforce the vacuum cleaning action.

Cleaning of a Ballast Bed

In this case, the dirt is pneumatically removed from the surface of the ballast bed and from the surface crevices, as shown in FIGS. 5 and 6. For this purpose, compressed air is delivered to nozzles 21, 46 in suction heads 26, 27, 28 to detach the dirt within inlet ports 17 of the suction head whence it is vacuumed through suction conduits 12 concentrically surrounding the nozzles. Particularly if the cleaning machine stands still over each crib, the entire surface of the cribs will be covered by the turbulent air flow within the suction head to provide a thorough cleaning action. All the slide valves 57, 61 of control devices 32, 33 are opened for the full operation of the compressed air delivering and suction conduits 20, 12 while exhaust port 49 of control device 32 is closed to establish a closed pressure-suction system operated by ventilator 15.

If the ballast bed surface is relatively clean, machine 1 may be continuously advanced in the operating direction indicated by arrow 54 while the rims of the suction heads are slightly spaced from the tie surfaces.

On the other hand, if the ballast bed surface is very dirty, cleaning is effected in two operating stages. In a first stage, the cleaning machine is continuously advanced along the track in the above-indiciated manner, drives 24, 47 being actuated to lower suction heads 26, 27, 28 so that their rims are slightly spaced from the tie surfaces. Drive 50 is actuated to close exhaust port 49 of control device 32 so that the exhaust air delivered by ventilator 15 passes into compressed air delivering conduits 20. As shown in FIG. 6, the resultant compressed air delivered by nozzles 21, 46 will blast the dirt off the ballast bed and this dirt will be carried by suction through conduits 12 into receptacle 13. Since the rims of the suction heads are slighly spaced from the tie surfaces, a little air will be sucked into the inlet ports of the suction heads from the surrounding atmosphere. If desired, the free-floating dust produced within the suction heads during this combined pressure-vaccum action may be bound by injecting water through nozzles 43 into the inlet ports. As the air stream laden with dirt and water enters receptacle 13 from suction conduits 12, the flow velocity is so reduced in the wide, umbrella-shaped nozzle 37 in the receptacle that the dirt is accumulated on the bottom of the receptacle (see FIG. 4). The capacity of receptacle 13 may be about ten cubic meters and the receptacle is emptied from time to time through slide gates at the bottom of the receptacle.

Before beginning a second operating stage preferably immediately following the first stage, cleaning machine 1 may first be returned without operating suction arrangement 11 to its initial position or the second stage may be initiated during this return. This second operating stage begins with a cyclical advance of the machine (see arrows 55 in FIG. 6) from crib 53 to crib 53. Over each crib, drives 24, 47 are actuated to lower suction heads 26, 27, 28 until their elastic rim ledges 18 engage ties 2, thus providing a suction cup effect (phantom lines in FIG. 6). This considerably enhances the cleaning effect, as compared to the first operating stage, the compressed air flow blasting adhering dirt from the surface and the suction vacuuming the detached dirt into receptacle 13. The centrally delivered compressed air is deflected 180° into the concentrically surrounding suction conduit to generate a powerful air stream over the entire area of the inlet port of the suction head, including its circumference, causing all the dirt to be removed while the suction cup effect of the elatic rim 18 in contact with the tie surfaces will prevent any air from escaping out of the inlet port. After each crib has been cleaned, drives 24, 27 are actuated to raise the suction heads slightly to disengage the suction head rims from the tie surfaces, and cleaning machine 1 is advanced to the next crib, where the cleaning action is repeated.

If the center of the track between rails 3 was sufficiently cleaned during the first operating stage, only outer suction heads 26, 28 are lowered by drives 24 and operated cyclically during the second stage. Actuation of drives 24 causes a relative verticaly displacement of carrier frames 23 and 45 respectively supporting suction heads 26, 28 and 27. In this case, as shown in FIGS. 7 and 8, center compressed air delivering conduit 20 and center suction conduit 12 are closed. This will save energy and will enhance the vacuum in outer suction heads 26, 28.

As described, this track bed cleaning method comprises the steps of lowering the suction head means until there is only a small gap between the surface of ties 2 and the suction head means while machine 1 is continuously advanced in the operating direction in a first operating stage, the suction applied to the inlet port means 17 and reinforced by the compressed air discharged from the nozzle means 21, 46 removing coarse superficial dirt from the track bed, and subsequently lowering the suction head means until rim 18 defining the inlet port means is in engagement with the surface of the ties while the machine is intermittently advanced from crib 53 to crib 53 in the operating direction in a second operating stage and is retained stationary at each crib, the suction applied to the inlet port means and reinforced by the compressed air discharged from the nozzle means removing further dirt from the track bed at each crib.

This method provides a particularly economical relationship between operating time and cleaning effect since the first operating stage effecting relatively superficial cleaning can proceed rapidly while the second stage provides intensive cleaning of stubborn dirt. In this second stage, the cleaning action can be selectively controlled, depending on the amount and type of dirt encountered, by using only some of the suction heads and/or by using only the compressed air and/or vacuum action. In other words, the cyclical cleaning can be individually tailored to prevailing conditions.

Figure 9:
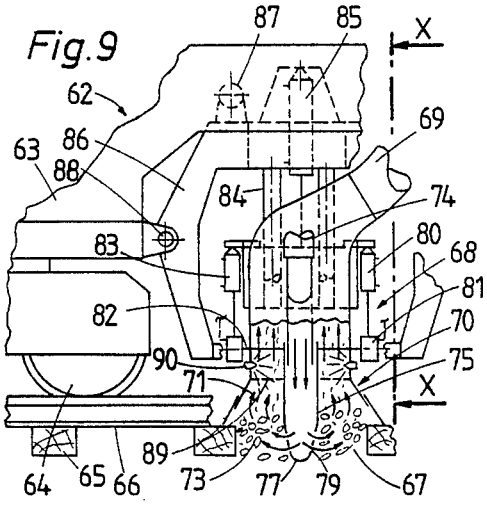
FIG. 9 is a fragmentary side elevational view of a mobile machine with another embodiment of the suction arrangement.
Figure 10:
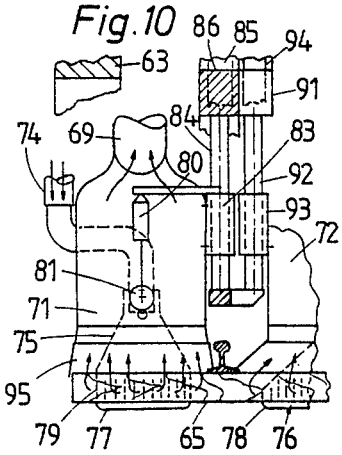
FIG. 10 is a sectional view along line X—X of FIG. 9.

FIGS. 9 and 10 illustrate track bed cleaning machine 62 generally of the same type as that described in connection with FIGS. 1 to 8 and comprising machine frame 63 and undercarriages 64 supporting the machine frame for mobility in an operating direction on a track consisting of two rails 66 fastened to ties 65 embedded in ballast bed 67. For cleaning the surface of the ballast bed, the machine frame carries suction arrangement 68 comprising suction head means 70 having inlet port means 73, suction conduit means 69, a ventilator connected to the suction head means by the suction conduit means for producing suction at the inlet port means, and a receptacle incorporating a filter connected to the suction conduit means. Suction head means 70 extends over the entire width of the track and comprises two outer suction heads 71 in registry with the opposite ends of ties 65 and center suction head 72 in registry with a track area between rails 66. The compressed air generating arrangement associated with suction arrangement 68 comprises a respective compressed air discharging nozzle 75, 76 arranged within, and projecting from, each inlet port 73 of suction head 71, 72, respectively. In this embodiment, the compressed air discharging nozzles are circular or slot-shaped blow pipes 77, 78 having a conical end defining compressed air blow openings 79. Compressed air delivering conduits 74 connect the blow pipes to a compressed air generator, as in the first-described embodiment. For vertically adjusting each blow pipe with respect to its suction head, vibrator 81 and vertical adjustment drive 80 is connected to the blow pipe. The upper, cylindrical end of the blow pipe is longitudinally displaceably guided in its cylindrical compressed air delivering conduit 74 and rod 82 links vibrator 81 to its vertically adjustable blow pipe, the linking rod passing through a slot in a side wall of the associated suction head. A rubber gasket seals this slot to prevent air from being sucked into the suction head from the surrounding atmosphere. Associated vertical adjustment drive 80 is connected to the vibrator. As shown, this is a cylinder-piston drive whose piston is linked to vibrator 81 while its cylinder is linked to carrier frame 83 vertically displaceably mounted on guide columns 84 and connected to vertical adjustment drive 85. The guide columns and the vertical adjustment drive are affixed to support frame 86 which is transversely displaceably mounted on transverse guides 88 of machine frame 6, transverse adjustment drive 87 being connected to the support frame for transverse adjustment thereof. A respective screen 89 covers each inlet port 73, the screen having meshes of a smaller size than that of the average ballast stone. In this way, any passage of ballast stones into the suction arrangement will be prevented even when a high vacuum is applied. After the cleaning action has been completed and the suction is discontinued, any ballast stones pressed against screen 89 by the suction will be automatically released from the screen and fall back into the crib.

Such blow pipes combined with vacuum cleaning provide a very intensive cleaning action reaching deep into the crevices of a ballast bed. Upon lowering of the suction head, the projecting blow pipe end will be automatically thrust into the ballast bed, thus loosening even heavily encrusted ballast. The compressed air blown out of the blow pipe nozzle openings will lift the broken-up encrustations and the applied suction will carry these encrustations into the dirt receptacle. The vertical adjustability of the blow pipe enables the immersion of the blow pipe into the ballast to be selectively adjusted in dependence on prevailing ballast bed conditions. For example, in particularly badly encrusted and dirty cribs, the blow pipe may be repeatedly thrust into the ballast without lifting the suction head and thus interrupting the vacuum action, which will further enhance the deep cleaning action. The vibration of the blow pipe will not only facilitate the immersion thereof in encrusted ballast but will also enhance the cleaning action.

Also similarly to the embodiment of FIGS. 1 to 8, water dispensing nozzle 90 is mounted in the suction head and is connected by a flexible hose to a water pump receiving water from a water tank carried on the machine frame.

As best shown in FIG. 10, support frame 86 for center suction head 71 is connected to another frame 91 and vertical guide columns 92. Carrier frame 93 for outer suction head 72 is vertically displaceably mounted on the guide columns and is connected to its own vertical adjustment drive 94. In this way, suction heads 71 and 72 are independently vertically adjustable for selective operation. Each suction head inlet port 73 is surrounded by elastic and vertically adjustable rim 95.

In general, cleaning machine 62 operates in a manner similar to that of machine 1 and this operation will be briefly described hereinafter.

To clean a heavily encrusted and very dirty ballast bed 67, the machine is intermittently moved from crib to crib, vertical adjustment drives 85, 94 being actuated at each crib while the machine stands still so that rims 95 engage the tie surfaces. At the same time, drives 80 and vibrators 81 are actuated to thrust the blow pipes into the ballast while the ventilator blows compressed air into the ballast bed through blow pipe openings 79 and sucks the dirt-laden air wetted by water from nozzles 90 through suction conduits 69 into the dirt receptacle. The ventilator produces the vacuum and the pressure in a closed system, as in the first-described embodiment. After cleaning each crib, the suction heads are lifted to enable the machine to advance to the next crib, where the cleaning operation is repeated. If the machine encounters a crib where the ballast is less encrusted, it is not necessary to lower the blow pipes into the ballast. In this case, the compressed air discharged through blow pipe openings 79 against the ballast bed surface operates in the same manner as shown and described in connection with FIG. 5. On the other hand, in a particularly heavily encrusted crib, the blow pipes may be repeatedly thrust into the ballast.

What is claimed is:

1. A mobile machine for cleaning a bed supporting a track consisting of two rails fastened to ties, which comprises (a) a machine frame, (b) undercarriages supporting the machine frame on the track rails for mobility in an operating direction, (c) a suction arrangement on the machine frame, the suction arrangement extending substantially over the entire width of the track and comprising (1) a suction head means having inlet port means, (2) a suction conduit means, (3) a ventilator having a suction port connected to the suction head means by the suction conduit means for producing suction at the inlet port means and an exhaust port, and (4) a receptacle incorporating a filter connected to the suction conduit means, and (d) a compressed air generating arrangement associated with the suction arrangement, the compressed air generating arrangement comprising (1) a compressed air discharging nozzle means arranged within the inlet port means of the suction head means, (2) a compressed air conduit means, and (3) compressed air generator means constituted by the exhaust port of the ventilator, the exhaust port being connected to the nozzle means by the compressed air conduit means, the inlet port means completely surrounding the compressed air discharging nozzle means whereby the suction and compressed air generating arrangements form a substantially closed pressure-suction system.

2. The mobile track bed cleaning machine of claim 1, wherein the inlet port means is constituted by a substantially rectangular inlet port.

3. The mobile track bed cleaning machine of claim 2, wherein the suction head means comprises three suction heads arranged adjacent each other transversely to the track, carrier frame means supporting the three suction heads, drive means for vertically adjusting the suction heads, each of the suction heads having a substantially rectangular inlet port and the compressed air discharging nozzle means comprises a respective nozzle arranged in each rectangular inlet port.

4. The mobile track bed cleaning machine of claim 3, further comprising drive means for transversely adjusting the suction heads.

5. The mobile track bed cleaning machine of claim 3, wherein a center one of the suction heads is arranged between the two track rails and a respective outer one of the suction heads is arranged laterally outside a respective one of the track rails, further comprising a respective control device arranged in the suction conduit means and the compressed air conduit means for selectively connecting either the center suction head or the outer suction heads with the exhaust port and the suction port of the ventilator, and remote control means for operating the control devices.

6. The mobile track bed cleaning machine of claim 5, wherein the control devices are valves.

7. The mobile track bed cleaning machine of claim 1, wherein the suction arrangement further comprises water discharging nozzle means above the inlet port means, and the machine frame carries a water tank and a water pump having an input and an output, the pump input receiving water from the water tank, and conduit means connecting the pump output to the water discharging nozzle means.

8. The mobile track bed cleaning machine of claim 7, wherein the water discharging nozzle means extends substantially horizontally through the suction head means.

9. The mobile track bed cleaning machine of claim 1, wherein a rim defines the suction head inlet port means and the rim comprises a vertically adjustable strip extending therefrom substantially to the surface of the ballast bed, except in the area of the two track rails.

10. The mobile track bed cleaning machine of claim 9, wherein the strip is of an elastic material.

11. The mobile track bed cleaning machine of claim 1, wherein the inlet port means has a width extending in the direction of the track which is greater than the average crib width.

12. A mobile machine for cleaning a bed supporting a track consisting of two rails fastened to ties, which comprises (a) a machine frame, (b) undercarriages supporting the machine frame on the track rails for mobility in an operating direction, (c) a suction arrangement on the machine frame, the suction arrangement extending substantially over the entire width of the track and comprising (1) a suction head means having inlet port means, (2) a suction conduit means, (3) a ventilator having a suction port connected to the suction head means by the suction conduit means for producing suction at the inlet port means and an exhaust port, and (4) a receptacle incorporating a filter connected to the suction conduit means, and (d) a compressed air generating arrangement associated with the suction arrangement, the compressed air generating arrangement comprising (1) a compressed air discharging nozzle means comprised of blow pipe means having a conical end defining compressed air blow openings, the nozzle means being arranged within the inlet port means of the suction head means, the inlet port means completely surrounding the blow pipe means and the conical end projecting from the inlet port means, (2) a compressed air conduit means, and
(3) compressed air generator means constituted by the exhaust port of the ventilator, the exhaust port being connected to the nozzle means by the compressed air conduit means, the suction and compressed air generating arrangements forming a substantially closed pressure-suction system.

13. The mobile track bed cleaning machine of claim 12, further comprising a vibrator and a vertical adjustment drive connected to the blow pipe means for vertically adjusting the blow pipe means with respect to the suction head means.

14. A mobile machine for cleaning a bed supporting a track consisting of two rails fastened to ties, which comprises (a) a machine frame,
(b) undercarriages supporting the machine frame on the track rails for mobility in an operating direction,
(c) a suction arrangement on the machine frame, the suction arrangement extending substantially over the entire width of the track and comprising
(1) a suction head means having inlet port means,
(2) a screen covering the inlet port means, the screen having meshes of a smaller size than that of the average ballast stone,
(3) a suction conduit means,
(4) a ventilator having a suction port connected to the suction head means by the suction conduit means for producing suction at the inlet port means and an exhaust port, and
(5) a receptacle incorporating a filter connected to the suction conduit means, and
(d) a compressed air generating arrangement associated with the suction arrangement, the compressed air generating arrangement comprising
(1) a compressed air discharging nozzle means arranged within the inlet port means of the suction head means,
(2) a compressed air conduit means, and
(3) compressed air generator means constituted by the exhaust port of the ventilator, the exhaust port being connected to the nozzle means by the compressed air conduit means, the inlet port means completely surrounding the compressed air discharging nozzle means whereby the suction and compressed air generating arrangements form a substantially closed pressure-suction system.

15. A method of cleaning a bed containing a large amount of dirt with a mobile machine, the bed supporting a track consisting of two rails fastened to ties, and the machine comprising a machine frame, undercarriages supporting the machine frame on the track rails for mobility in an operating direction, a suction arrangement on the machine frame, the suction arrangement extending substantially over the entire width of the track and comprising a suction head means having an inlet port means, suction conduit means, a ventilator having a suction port connected to the suction head means by the suction conduit means for producing suction at the inlet port means and an exhaust port, and a receptacle incorporating a filter connected to the suction conduit means, and a compressed air generating arrangement associated with the suction arrangement, the compressed air generating arrangement comprising a compressed air discharging nozzle means arranged within the inlet port means of the suction head means, a compressed air conduit means, and a compressed air generator means constituted by the exhaust port of the ventilator, the exhaust port being connected to the nozzle means by the compressed air conduit means, the inlet port means completely surrounding the compressed air discharging nozzle means whereby the suction and compressed air generating arrangements form a substantially closed pressure-suction system, which track bed cleaning method comprises the steps of (a) lowering the suction head means until there is only a small gap between the surface of the ties and the suction head means while the machine is continuously advanced in the operating direction in a first operating stage, the suction applied to the inlet port means and reinforced by the compressed air discharged from the nozzle means removing coarse superficial dirt from the track bed, and
(b) subsequently lowering the suction head until the rim defining the inlet port means is in engagement with the surface of the ties while the machine is intermittently advanced from crib to crib in the operating direction in a second operating stage and is retained stationary at each crib, the suction applied to the inlet port means and reinforced by the compressed air discharged from the nozzle means removing further dirt from the track bed at each crib.

16. The track bed cleaning method of claim 15, wherein the track bed is a ballast bed wherein the track ties are embedded, and the compressed air discharging nozzle means is comprised of a vertically adjustable blow pipe means, further comprising the step of subjecting the blow pipe means to vibrations to immerse the vertically adjustable blow pipe means into the ballast bed at each crib while the machine is retained stationary.

* * * * *